United States Patent [19]

Pudras

[11] 4,088,082

[45] May 9, 1978

[54] DEVICE WITH FUNCTIONAL UNITS HOUSED IN AN ARMORED BOX AND IN NEED OF PROTECTION, E.G. AUTOMATIC MONEY-DISPENSING MACHINE

[75] Inventor: Horst Pudras, Munich, Germany

[73] Assignee: G.A.O. Gesselschaft für Automation und Organisation mbH, Germany

[21] Appl. No.: 759,367

[22] Filed: Jan. 14, 1977

[30] Foreign Application Priority Data

Feb. 2, 1976 Austria ..... 715/76

[51] Int. Cl.[2] ..... E05G 1/06

[52] U.S. Cl. ..... 109/53

[58] Field of Search ..... 109/47, 52, 53, 56, 109/57; 194/1 A, 4 R

[56] References Cited

U.S. PATENT DOCUMENTS

| | | | |
|---|---|---|---|
| 1,647,275 | 11/1927 | Cursons | 109/47 X |
| 3,499,513 | 3/1970 | Armstrong et al. | 194/4 R |
| 3,667,406 | 6/1972 | Shea | 109/57 |
| 3,837,300 | 9/1974 | Karr | 109/57 |
| 3,970,010 | 7/1976 | Cantley | 109/56 |

FOREIGN PATENT DOCUMENTS

| | | | |
|---|---|---|---|
| 198,935 | 7/1938 | Switzerland | 109/56 |

*Primary Examiner*—Paul R. Gilliam
*Assistant Examiner*—David H. Corbin
*Attorney, Agent, or Firm*—McGlew and Tuttle

[57] ABSTRACT

The present invention relates to a device with functional units housed in an armored box and in need of protection, e.g. to an automatic money-dispensing machine. The functional units are accommodated on a pull-out slide-in frame and are closed with an armor plate at the door end, and the armor plate has openings which permit access only to the parts to be serviced.

4 Claims, 3 Drawing Figures

DEVICE WITH FUNCTIONAL UNITS HOUSED IN AN ARMORED BOX AND IN NEED OF PROTECTION, E.G. AUTOMATIC MONEY-DISPENSING MACHINE

To protect the functional units, such as mechanical and electronic subassemblies, of automatic money-dispensing machines against unauthorized access by third parties, such equipment is commonly housed in an armoured box which, like customary safes, is equipped with refractory walls, a combination lock, and the like. In addition, the rooms where this equipment is installed are carefully monitored by alarm devices, so the possibility of forcible entry can be nearly excluded, but the customer has access to the operating elements.

Although this equipment is protected against forcible access at a high cost, its safety system has a relatively large gap. In the case of conventional equipment, the group of persons able and allowed to work on the open equipment has free access to the mechanical parts and to the entire electronic circuitry although this is not necessary and desirable in many cases.

The object of the invention is, therefore, to provide a device containing functional units in need of protection, e.g. an automatic money-dispensig machine, wherein it is ensured that, even during maintenance work, only the part to be maintained is accessible to the maintenance personnel so that different safety steps can be formed.

According to the invention, the functional units are accommodated on a pull-out slide-in frame and are closed with an armour plate at the door end, and the armour plate has openings which permit access only to the parts to be serviced.

Avoiding the known disadvantages, the invention offers a few essential advantages. In particular, it is no longer possible for the loading personnel to carry out any undetectable fraudulent manipulations on the equipment because access is limited to a few component parts of the installation even if the door is open. With the construction on a safety step basis, particularly exposed units are protected against manipulations and spying by additional armoured partitions. If the slide rails of the slide-in frame are provided with locks in those positions in which they are flush with the partitions in the box, access can be limited to specific component parts and structural units with maximum safety. Specific repairs can thus be performed only by specialists selected in strict observance of safety regulations.

Figure 2:
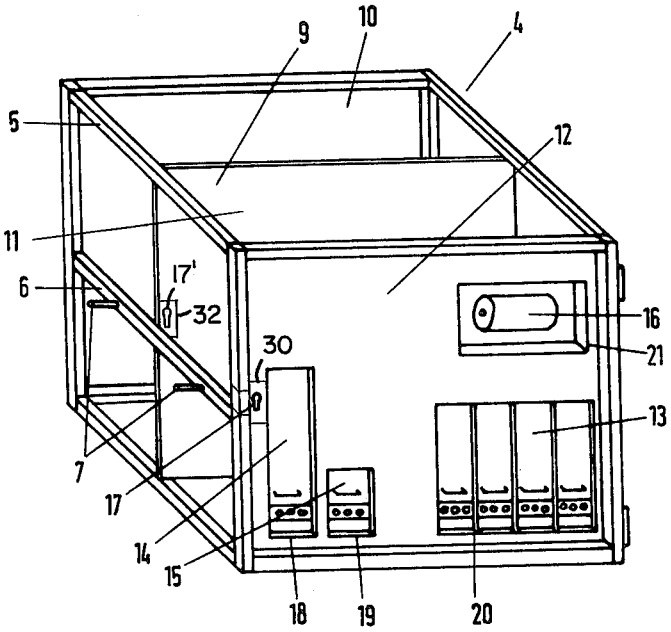
Figure 3:
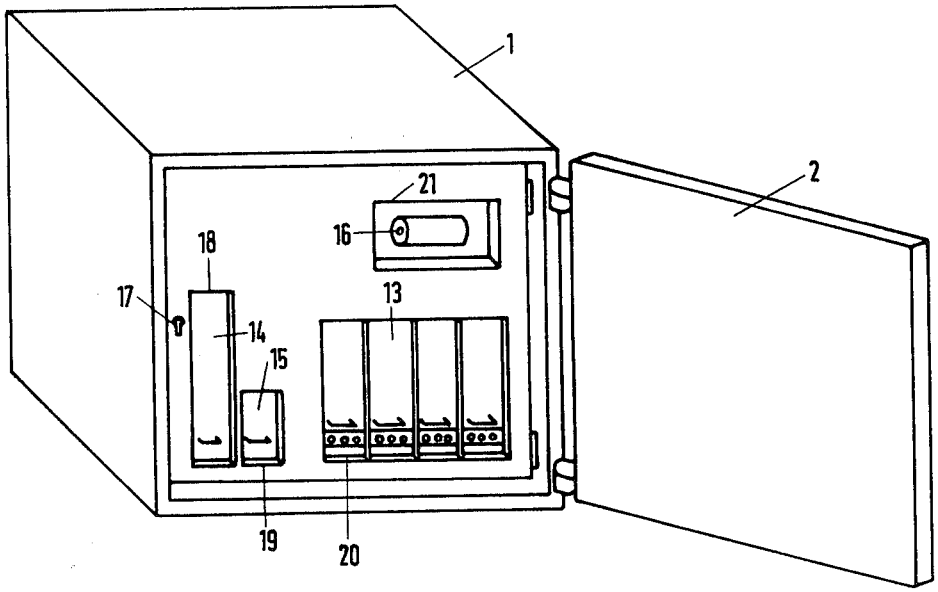

Further advantages of the invention will be apparent from the claims and from the following description of an embodiment in which reference is made only to details essential to the invention. In the accompanying drawings, FIG. 1 is a perspective view of the open armoured box of the device according to the invention without functional units;

FIG. 2 is a perspective view of the slide-in frame with the functional units, and FIG. 3 is a perspective view of the armoured box with inserted slide-in frame.

Figure 1:
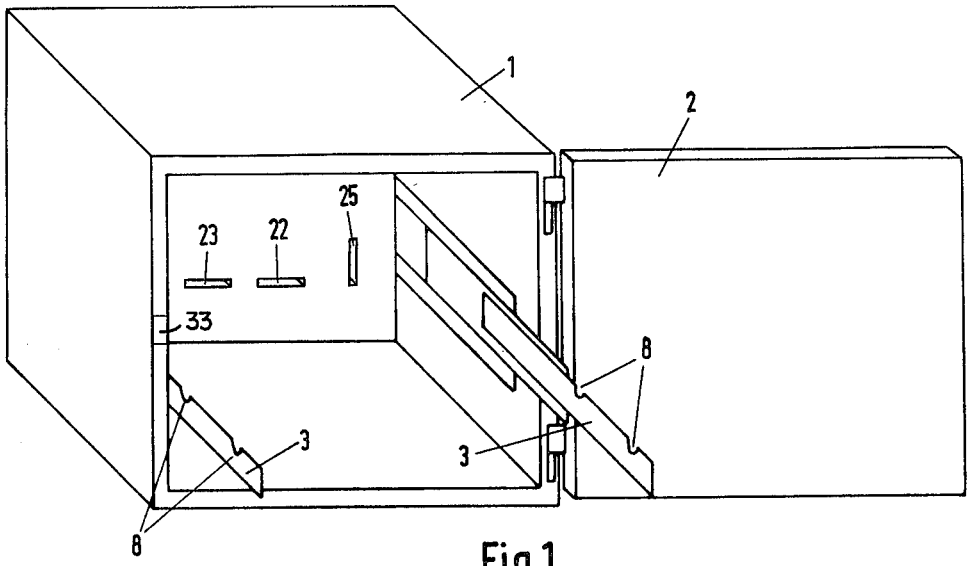

FIG. 1 shows the open armoured box 1 which is to house the functional unit to be protected. The functional unit 4 is shown in FIG. 2 and represents an automatic money-dispensing machine. The armoured box 1 can be closed with the door 2 and has pull-out slide rails 3 on the insides of both side walls.

The automatic money-dispensing machine 4 comprises frame 5 with a lateral crosspieces 6 at which pins 7 are provided. By means of the pins 7 the frame 5 can be hung into the notches 8 of the slide rails 3; then, it can be slid into the armoured box 1. This ensures that the functional parts of the automatic money-dispensing machine assume a defined position relative to one side wall and to the pin of the box 1 irrespective of the mostly very large manufacturing tolerances of the box. The frame can be secured in the rails 3 by means of known screw caps or quick-acting locks (not shown). The partition 9 divides the automatic money-dispensing machine 4 into a back compartment 10 and a front compartment 11. The compartments 10 and 11 house the functional and component parts (not shown) of the automatic money-dispensing machine. The frame 5 is closed at the front by an armoured door 12; the armoured door 12 has openings 18 to 21 which permit access to the money containers 13, the data sheets or banks 14 and 15, and the journal roll 16 when the door is closed.

FIG. 3 shows the armoured box 1 with the frame 5 slid in and locked by means of a lock (not shown) operated through a keyhole 17. After the armoured door 2 has been closed, the automatic machine is ready for service, i.e., following insertion of a valid identification card and of an associated cheque through the slots 22, 23 of the front wall of the box, and after a positive check of these input media, the desired amount of money can be dispensed to the customer through the slot 25. During routine checks and to replace the journal roll 16, it is only necessary to open the armoured door 2, while the armoured door 12 remains locked.

For servicing purposes, the authorized person can unlock the lock 17 so that the frame 5 can be pulled out. It is also possible to introduce further degrees of safety. This can be done by housing the functional units (not shown) with a high degree of safety in the room 10 and providing locking devices (not shown) at the partition 9 which, after the lock 17 has been unlocked, permit the frame 5 to be pulled out only to the point where the partition 9 is flush with the front side of the frame 5. Only when the authorized person has unlocked a lock (not shown) operable by inserting a key in a keyhole 17′ can the frame 5 be pulled out completely. The individual functional units are then freely accessible either from the side or, after the armoured door 12 or the partition 9 has been unlocked, from the rear. By contrast, the component parts contained in the box are shielded by the partition 9, which is flush with the edge of the box. The interaction or the arrangement of all components can, therefore, be seen only at the safety step at which the slide-in frame has been completely pulled out of the box. However, since the individual locking steps can be unlocked only with different keys, the authorized group of persons can be restricted as required.

the keyholes 17 and 17′ constitute, together with lock bolt parts 30 and 32 and a receiver 33, key openable lock means associated with the door 12 and the partition 9, respectively, which are actuable for lockable engagement with a front lock bolt receiver 33 in the armored box 1.

What is claimed is:

1. A security bolt, comprising an armored box having an opening at one end, a closable door pivotally mounted adjacent said one end for opening and closing the opening, a suspension frame slide guide in said box extending along respective opposite sides of the interior thereof, a frame suspension slide guided in each slide guide, an open rectangular box frame carried on said frame suspension sides and having a bottom, a front wall closing the front of said frame, a partition wall substantially parallel to said front wall and spaced rearwardly therefrom and dividing the interior frame into a front compartment between said front wall and said partition wall and a rear compartment between said wall and the rear of said frame, each front and rear compartment being adapted to contain separate functional units, and key openable lock means carried on said partition wall and said front wall and said armored box at a location adjacent said closable door for locking said frame against further withdrawal beyong the alignment of the associated one of said partition wall and said front wall with the opening of said armored box.

2. A security bolt according to claim 1, wherein said frame includes a pin projecting outwardly from each side at spaced locations along the length of said frame, said slide having upwardly opening notches defined along the length thereof which are engageable by the respective pins to support said frame on said slide.

3. A security bolt according to claim 1, wherein said front wall comprises an armored wall.

4. A security bolt according to claim 1, wherein said partition wall is an armored wall.

* * * * *